United States Patent [19]

Westergren

[11] 3,935,898

[45] Feb. 3, 1976

[54] DEVICE FOR AIR-CONDITIONING A NUMBER OF ROOMS THE HEAT REQUIREMENTS OF WHICH ARE DIFFERENT AND VARY PREFERABLY WITH RESPECT TO TIME

[75] Inventor: Folke Westergren, Skarholmen, Sweden

[73] Assignee: Aktiebolaget Svenska Flaktfabriken, Nacka, Sweden

[22] Filed: Sept. 25, 1974

[21] Appl. No.: 509,126

[30] Foreign Application Priority Data

Oct. 2, 1973 Sweden ..... 7313422

[52] U.S. Cl. ..... 165/22; 98/38 R; 98/40 DL; 165/1; 236/49

[51] Int. Cl.[2] ..... F24F 3/00

[58] Field of Search ..... 98/40 DL, 38; 236/49; 165/22, 1, 26, 30

[56] References Cited

UNITED STATES PATENTS

| | | | |
|---|---|---|---|
| 3,193,001 | 7/1965 | Meckler | 98/40 DL |
| 3,354,946 | 11/1967 | Dean | 98/40 DL |
| 3,812,904 | 5/1974 | Westergren | 165/22 |
| 3,841,393 | 10/1974 | Gilles | 98/40 DL |

*Primary Examiner*—Charles J. Myhre
*Assistant Examiner*—Daniel J. O'Connor
*Attorney, Agent, or Firm*—Dorfman, Herrell and Skillman

[57] ABSTRACT

A system for air-conditioning an installation having a number of rooms, the heat requirements of which are different and vary preferably with respect to time, which rooms are connected to a central air-conditioning unit. Light fixtures producing radiation heat are mounted in said rooms and are cooled in known manner by discharge air from the rooms to reduce the radiation heat. The temperature of the air from the central unit is maintained not higher than required for the room in the installation which has the greatest heat development, and the radiation heat from said light fittings is utilized and adjusted to additionally heat the rooms as described in U.S. Pat. No. 3,812,904. The adjustment provides maximum room heating by minimizing the cooling by the discharge air and minimum room heating by maximizing the cooling by the discharge air, minimum room ventilation flow being met when providing maximum heating and the flow increasing as heating is reduced.

7 Claims, 5 Drawing Figures

A-A

B-B

DEVICE FOR AIR-CONDITIONING A NUMBER OF ROOMS THE HEAT REQUIREMENTS OF WHICH ARE DIFFERENT AND VARY PREFERABLY WITH RESPECT TO TIME

The present invention relates to an air-conditioning system which controls the heating effect of light fixtures by cooling the fixture with discharge air from the room.

In particular the invention is characterized primarily in that the air flow through a room is adjusted between a highest value adapted for the maximum cooling demand and a minimum value adapted for the necessary ventilation demand, in such a manner, that the discharge air is divided into a constant portion constituting the minimum flow for adequate ventilation and a second portion varying with the cooling demand, which is passed through or around the fluorescent tube fixtures. The variable portion of the discharge air is adjusted by a thermostat-controlled adjusting device between highest value and zero, in which latter position the electric effect supplied to the fixtures is utilized for room heating whereby the range of adjustability is increased, and that the supply air flow is varied by a thermostat-actuated adjusting device so as to be the total of said constant and said variable discharge air flow. An advantageous embodiment of the device is characterized in that the constant portion of the discharge air flow is passed through a by-pass duct. According to another preferred embodiment the constant portion of the discharge air flow is passed through a so-called discharge air window of a design known per se.

The device according to the invention, as is apparent from the following description of the figures, implies that the lighting and ventilation have been integrated in one unit, which results in a simpler and less expensive installation system and thereby renders it possible that this technically valuably ventilation system can be applied more widely.

The device being described here includes basic components of the same kind as set forth in U.S. Pat. No. 3,812,904. The further development lies in the feature that now the supply and discharge air flow is varied from maximum to minimum where the maximum total air flow is adjusted to correspond to maximum cooling demand in the room and the minimum air flow is adjusted to correspond to the air flow necessary for ventilation.

The invention has as its object to additionally increase the adjustability and to improve the operation economy to the highest possible degree. By reducing now the supply air and discharge air flow to a minimum value at the highest demand of heat radiation, the smallest amount of heat is discharged from the room via the discharge air. At low outdoor temperatures the supply air temperature is increased to a temperature immediately below the room temperature. If the heat demand in the room exceeds the heat emitted by the light fixtures or fittings in the room, it is possible to equip in a simple way the supply air device with an after-heating battery or heat exchanger. One difference compared with conventional systems operating with variable air flow is that both the supply air and discharge air flows are adjusted in each room and that the control device is assembled to one unit.

The invention is described in greater detail in the following, with reference to the enclosed drawings, in which.

Figure 1:
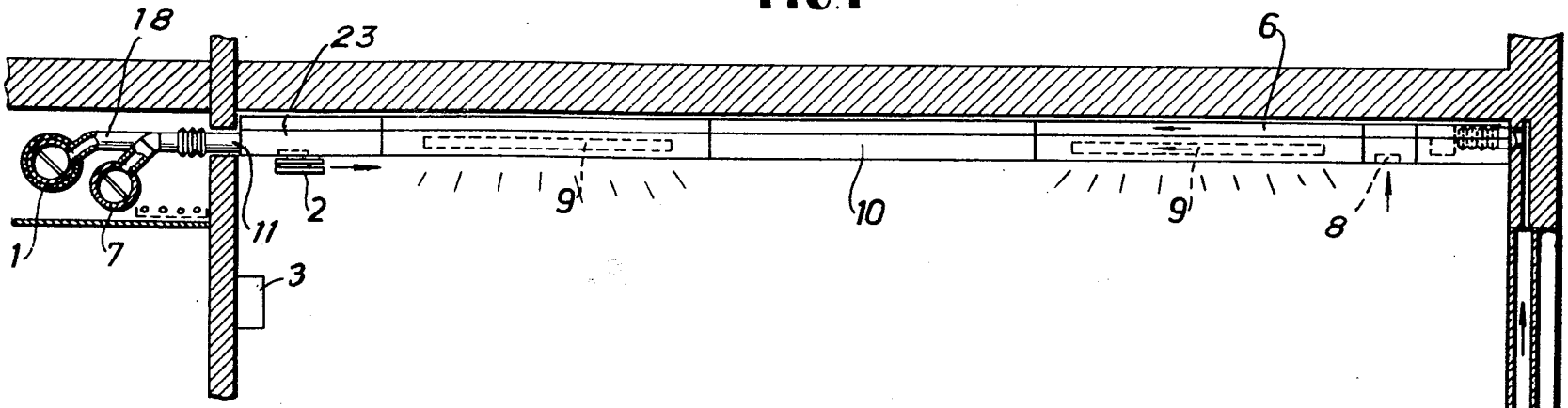
FIG. 1 is a longitudinal section through a room provided with window and light fixtures or fittings.
Figure 5:
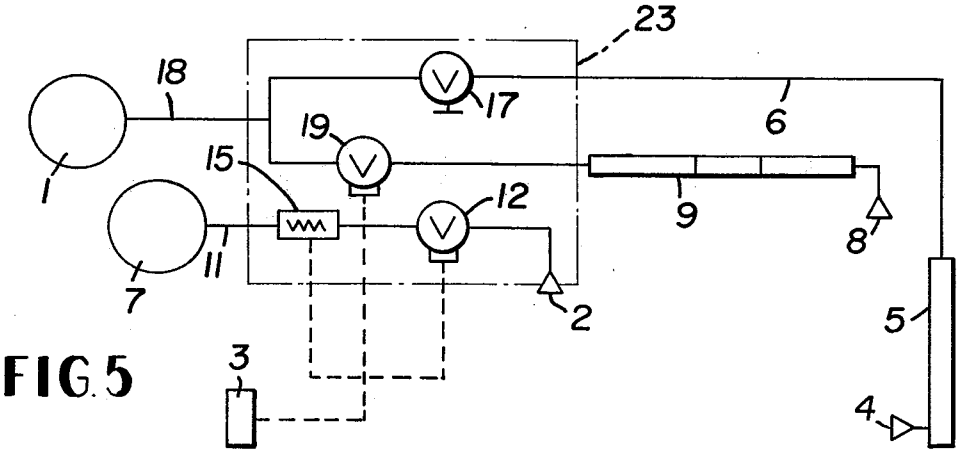
FIG. 5 is a diagrammatic illustration of the control shown in FIG. 1

Pretreated air is supplied from a central unit (not shown) to the room via a supply air duct 7 and a supply air device 2. This supply air flow is varied in the control part 23 according to the cooling or heat demand of the room and controlled by a thermostat 3.

A constant air amount (smallest ventilation air amount) is sucked in through a slot 4 beneath the window 5 and passes between the inner panes where the discharge air takes up the solar radiation heat and prevents it from entering the room, at the same time as the transmission to and from the room is decreased. Upon the passage of the discharge air along the window the inner pane is heated and thereby prevents a sudden temperature drop. Therefore, no radiators must be installed beneath windows. From the discharge air window the air is passed through a duct 6, control part 23, connection piece 18 and discharge air duct 1 to a discharge air fan where the discharge air either is blown out into the free air or a certain portion of which is returned as return air to a central supply air unit.

Residual discharge air is evacuated through a discharge air opening 8 and passes through the light fixtures or fittings 9, which are connected by one or several intermediate parts 10 and form a "light ramp" in the room. When the discharge air is passing through the light fittings, a large part of the supplied electric heat effect is removed and, thus, the necessary cooling energy to be supplied to the room is reduced.

At decreasing temperature in the room, as indicated by the thermostat 3, the supply air, controlled by the thermostat, is successively decreased and at the same time the discharge air passing through the fittings is reduced in the same amount so that the cooling effect or ventilation degree through the fittings is lowered and more heat is supplied to the room. At minimum supply air flow no discharge air passes through the fittings 9, so that the entire electric effect supplied is delivered to the room and heats the same.

Figure 2:
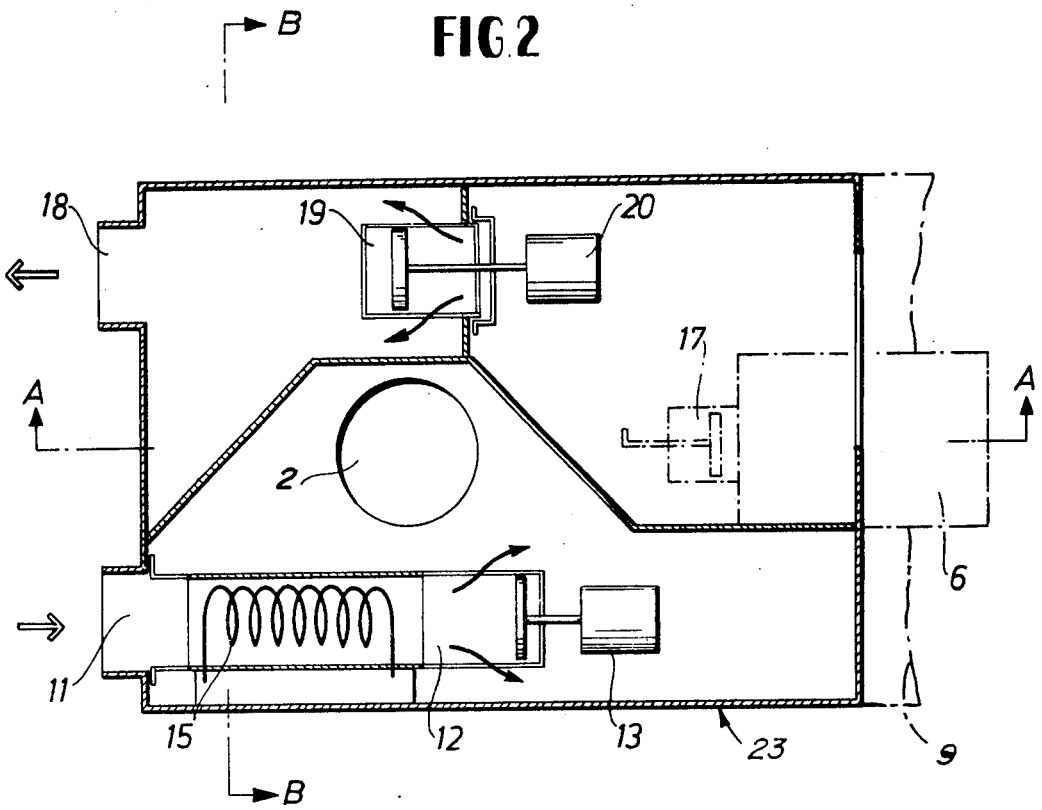
FIG. 2 is a longitudinal section through the control part of the device for adjustment of the supply air and discharge air.
Figure 3:
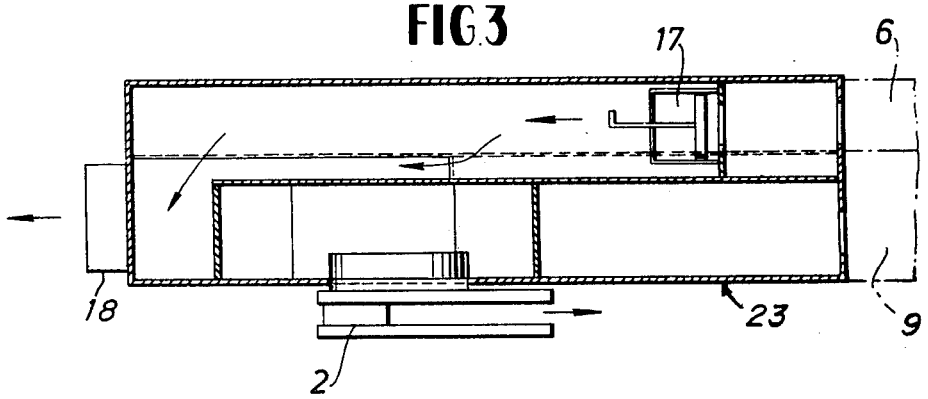
FIGS. 3 and 4 are sectional views taken on the line A—A B—B respectively of FIG. 2
Figure 4:
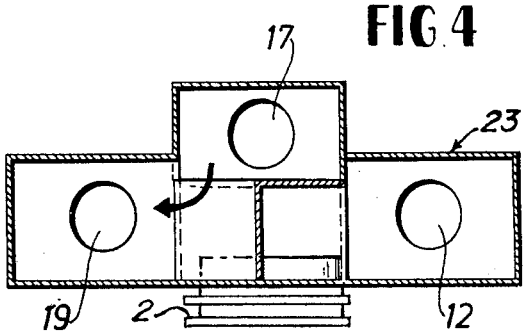

The control part 23 for adjusting the supply and discharge air is designed as shown in FIGS. 2 to 4 and operates as follows:

The pretreated supply air is delivered to the control part 23 through a connection piece 11 and passes through a control device 12, which is driven by a variable speed motor 13 (electric or pneumatic). The variable speed motor is controlled by the room thermostat 3 so that the supply air increases or decreases according to the prevailing cooling or heating demand in the room. The supply air is delivered into the room via the supply air device 2. The control part 23 can be provided, if necessary, with an electric afterheater 15, which also is controlled by the aforesaid room thermostat. Said afterheater is switched-in first after the supply air flow has been reduced to minimum. The discharge air having not passed through the fittings 9 is evacuated through the separate by-pass duct 6 and passes through an adjusting device 17 at which constant air flow is set. The pressure drop above the device can be set between 10 and 25 mm WC. The discharge air is evacuated to the discharge air system, which is connected to the connection piece 18.

The discharge air passing through the discharge air opening 8 and the fittings 9 is evacuated via an adjusting device 19, which is controlled by a variable speed motor 20 of the same type as the variable speed motor 13. When 12 is at minimum value, 19 shall be at zero. Thus, at minimum supply air flow the adjusting means 19 is entirely closed and no discharge air can pass this way.

The adjusting devices 12 and 19 are controlled by the same room thermostat 3.

The aforedescribed system can also be utilized for so-called inner zones, i.e. rooms without discharge air windows. In this case all discharge air passes through the fittings 9, but the adjustment in general takes place in the same way as in the alternative comprising exhaust windows.

I claim:

1. A method for air-conditioning a number of rooms, the heat requirements of which are different and vary preferably with respect to time, which rooms are connected to a central air-conditioning unit, and light fixtures producing radiation heat are mounted in said rooms and cooled in known manner by discharge air from the rooms to reduce the radiation heat, the temperature of the air from the central unit being maintained not higher than required for the room in the installation which has the greatest heat development, and the radiation heat from said light fixtures being utilized and adjusted to additionally heat the rooms, characterized in that the air flow through a room is adjusted between a highest value adapted for the maximum cooling demand and a minimum value adapted for the necessary ventilation demand, in such a manner, that the discharge air is divided into a constant first portion constituting said minimum flow and a second portion varying with the cooling demand which is passed in heat exchange with the fixtures, that the variable portion of the discharge air is adjusted between highest value and zero, in which latter position the electric heating effect of the fixtures is utilized for room heating whereby the range of adjustability is increased, and that the supply air flow is varied so as to be the total of said constant and said variable discharge portions.

2. An individual room control device in a system for air-conditioning a number of rooms comprising means to introduce a flow of central air into said individual room at a temperature below the desired room temperature, a light fixture to supply additional heat to said room, means to discharge a first constant flow of discharge air from said room, means to discharge a second flow of discharge air from said room into heat exchange relation with said fixture to reduce the heat supplied to said room by said fixture, a thermostat fan sensing the temperature of said room, a discharge control device controlled in response to said thermostat for varying said second flow between a minimum and a maximum, and an inlet control device controlled in response to thermostat to introduce central air in an amount corresponding to the sum of said first and second discharge flows.

3. A device according to claim 2 wherein said second flow control device is regulated from zero flow to the maximum flow.

4. A device according to claim 3 including a heat exchange device in said inlet controlled by said thermostat to heat said inlet air when said second discharge flow is reduced to zero.

5. A device according to claim 2 for air-conditioning a number of rooms, characterized in that the constant portion of the discharge air flow is passed through a by-pass duct, and the variable portion is passed through the lighting fixture.

6. A device according to claim 2 for air-conditioning a number of rooms, characterized in that the constant portion of the discharge air flow is passed through a discharge air window.

7. A device according to claim 2 including a manually adjustable control for regulating said first constant flow to a value which provides the minimum necessary ventilating air for the room.

* * * * *